US008267411B2

(12) United States Patent
Lin

(10) Patent No.: US 8,267,411 B2
(45) Date of Patent: Sep. 18, 2012

(54) SIZE-ADJUSTING FASTENING MECHANISM FOR ICE SKATES

(75) Inventor: Jiahe Lin, Foshan (CN)

(73) Assignee: Foshan City Senhai Sporting Goods Co., Ltd, Foshan (CN)

( * ) Notice: Subject to any disclaimer, the term of this patent is extended or adjusted under 35 U.S.C. 154(b) by 67 days.

(21) Appl. No.: 12/848,981

(22) Filed: Aug. 2, 2010

(65) Prior Publication Data

US 2011/0187066 A1 Aug. 4, 2011

Related U.S. Application Data

(63) Continuation-in-part of application No. 11/947,763, filed on Nov. 29, 2007, now Pat. No. 7,789,399.

(51) Int. Cl.
*A63C 1/22* (2006.01)

(52) U.S. Cl. ..... 280/11.16

(58) Field of Classification Search ..... 280/841, 280/11.19–11.28, 811
See application file for complete search history.

(56) References Cited

U.S. PATENT DOCUMENTS

2004/0217562 A1* 11/2004 Haugen et al. ..... 280/11.221

* cited by examiner

*Primary Examiner* — Jeffrey J Restifo
*Assistant Examiner* — Erez Gurari
(74) *Attorney, Agent, or Firm* — Chen Yoshimura LLP

(57) ABSTRACT

The present invention relates to a size-adjusting fastening mechanism for stakes comprising fixed locking grooves and a movable locking convex block, whereby when one of the grooves engages with the convex block, tooth position is loosened and toecap is telescopic upon pulling. When the groove and the convex block are rotated to deflect so as not to engage with each other, tooth position is pressed to lock so as to be irremovable. Such a structure requires that the pull handle be pulled horizontally forwards and backwards. Being secured with rivet punching, the claimed device possesses good stability, is simple in structure, low in cost and easy for operation.

5 Claims, 7 Drawing Sheets

SIZE-ADJUSTING FASTENING MECHANISM FOR ICE SKATES

This application is a continuation-in-part of application Ser. No. 11/947,763, filed on Nov. 29, 2007, now pending.

FIELD OF THE INVENTION

The present invention relates to a size-adjusting device for single-roller and double-roller skates and ice stakes, and more particularly to a fastening mechanism of the size-adjusting device.

BACKGROUND OF THE RELATED ARTS

A conventional size-adjustable skate comprises a set of detachable shoe body and toecap. A size-adjusting structure is disclosed, for instance, in Chinese Patent Application 200420094683.3, wherein long groove holes adjustable in the longitudinal direction and in engagement with each other are disposed at a front end of the shoe body and at the toecap, and an eccentric cam fastening mechanism is disposed on the shoe body. The eccentric cam fastening mechanism comprises an eccentric cam, a rotational handle, a rotatable pin shaft and a cam sheath adjustable stand, of which the eccentric cam and the rotational handle are secured on the rotatable pin shaft, the cam sheath adjustable stand goes through the adjustable long groove holes of the shoe body and the toecap, and the eccentric cam is removably sheathed inside the cam sheath adjustable stand and is rotatable therein. The cam sheath adjustable stand is of a T shape, on which is disposed a cam hole having an aperture two times bigger than the bigger radius of the eccentric cam. Due to the arrangement of an eccentric cam fastening mechanism, this product is capable of being adjusted as to the position of the toecap with regard to the shoe body when the bigger radius of the cam faces upwards, that is to say, the size of the shoe is adjusted thereby, while the shoe body and the toecap are fastened when the bigger radius of the cam faces downwards. Its size-adjusting fastening mechanism is relatively complicated in structure, and it is therefore necessary to make further improvement and perfection thereto.

SUMMARY OF THE INVENTION

The objective of the present invention is to provide a size-adjusting fastening mechanism for ice skates with simple and rational structure, easy fabrication and convenient operation.

The technical solution employed by embodiments of the present invention to solve its technical problem is as follows.

Proposed is a size-adjusting fastening mechanism applicable for single-roller and double-roller skates and ice stakes and comprising fastening bolts (or rivets) of longitudinal adjustable long groove holes going through a shoe body and a toecap, fixed fastening blocks disposed on the shoe body and movable fastening blocks securely connected with the fastening bolts or rivets. The size-adjusting fastening mechanism is characterized in that the fixed fastening blocks and the movable fastening blocks are provided with concave grooves and convex blocks arranged in pairs.

The concave grooves are of arc shapes in sections.

The concave grooves include locking grooves and unlocking grooves perpendicularly arranged with regard to each other, and there is a difference in height between the bottom surface of the locking grooves and the bottom surface of the unlocking grooves, which difference in height is greater than a summation of tooth heights of positioning buckle teeth of the shoe body and the toecap.

The movable fastening blocks are provided with a handle.

The locking grooves are arranged in parallel along the length direction of the shoe body, so that a locked state remains no matter whether the handle of the movable fastening blocks is rotated forwards or backwards.

Embodiments of the present invention makes use of groove engagement, is simple in structure, low in production cost and easy for operation.

DETAILED DESCRIPTION OF THE PREFERRED EMBODIMENTS

Figure 1:
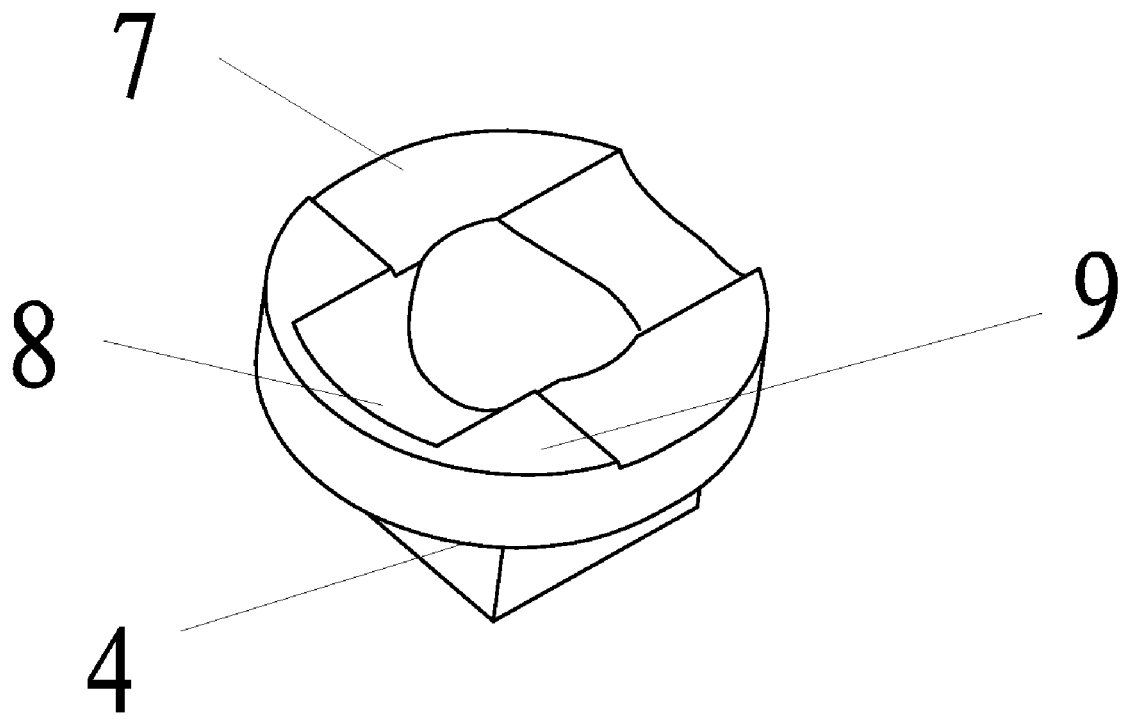
FIG. 1 is a view showing the structure of the fixed fastening block according to an embodiment of the present invention.

FIG. 1 shows the structure of a fixed fastening block 4 according to an embodiment of the present invention. The fixed fastening block 4 is provided with a locking groove 7 and an unlocking groove 8 perpendicularly arranged with regard to each other, wherein the locking groove 7 is disposed in parallel along the length direction of a shoe body 1 (see FIG. 3), and its bottom surface differs in height from the bottom surface of the unlocking groove 8, which difference in height is greater than a summation of tooth heights of positioning buckle teeth of the shoe body 1 and a toecap 2 (see FIG. 3). Both the locking groove and the unlocking groove 8 are of arc shapes in sections. A convex surface 9 holds a convex block 10 (see FIG. 2) in place to prevent a handle 11 (see FIG. 2) from rotating in case of drastic movement.

Figure 2:
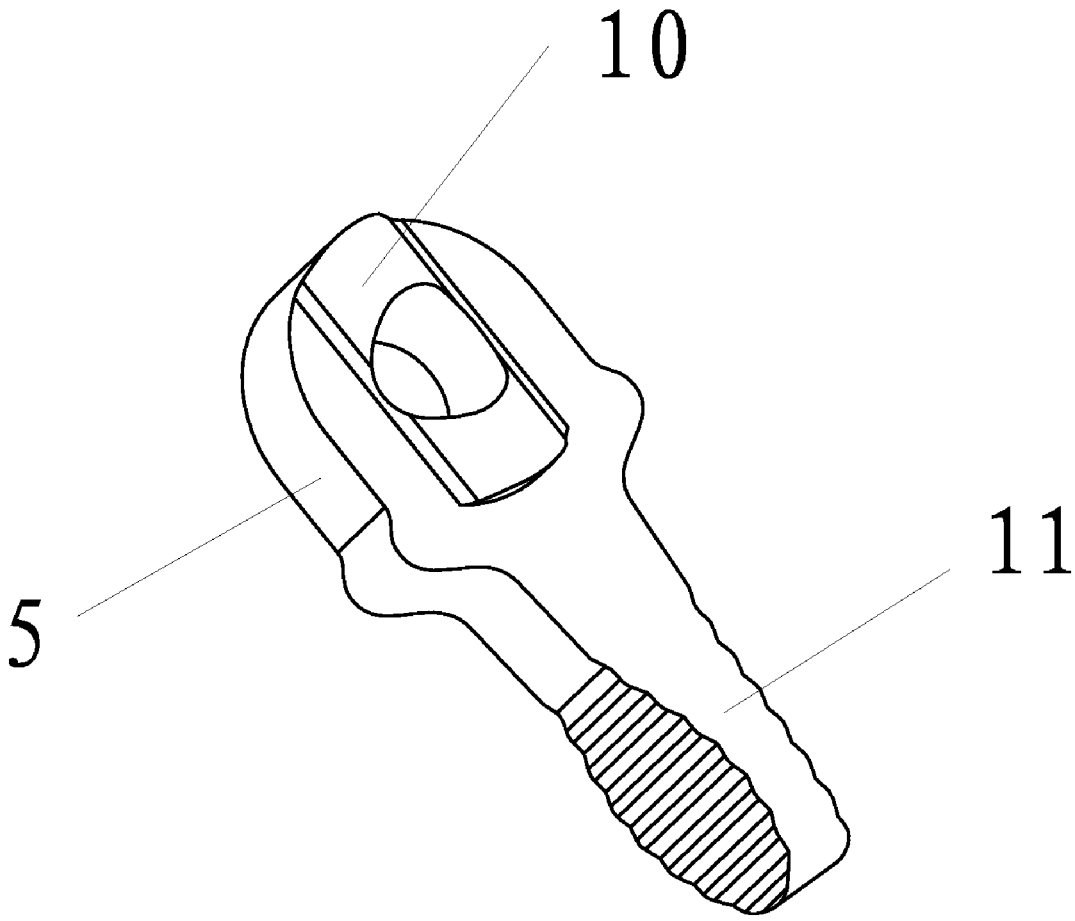
FIG. 2 is a view showing the structure of the movable fastening block according to the embodiment.

FIG. 2 shows the structure of a movable fastening block 5 according to the embodiment. The movable fastening block 5 is provided with a convex block 10 to correspond to the concave groove of the fixed fastening block 4 as shown in FIG. 1. The movable fastening block 5 is additionally provided with a handle 11.

Figure 3:
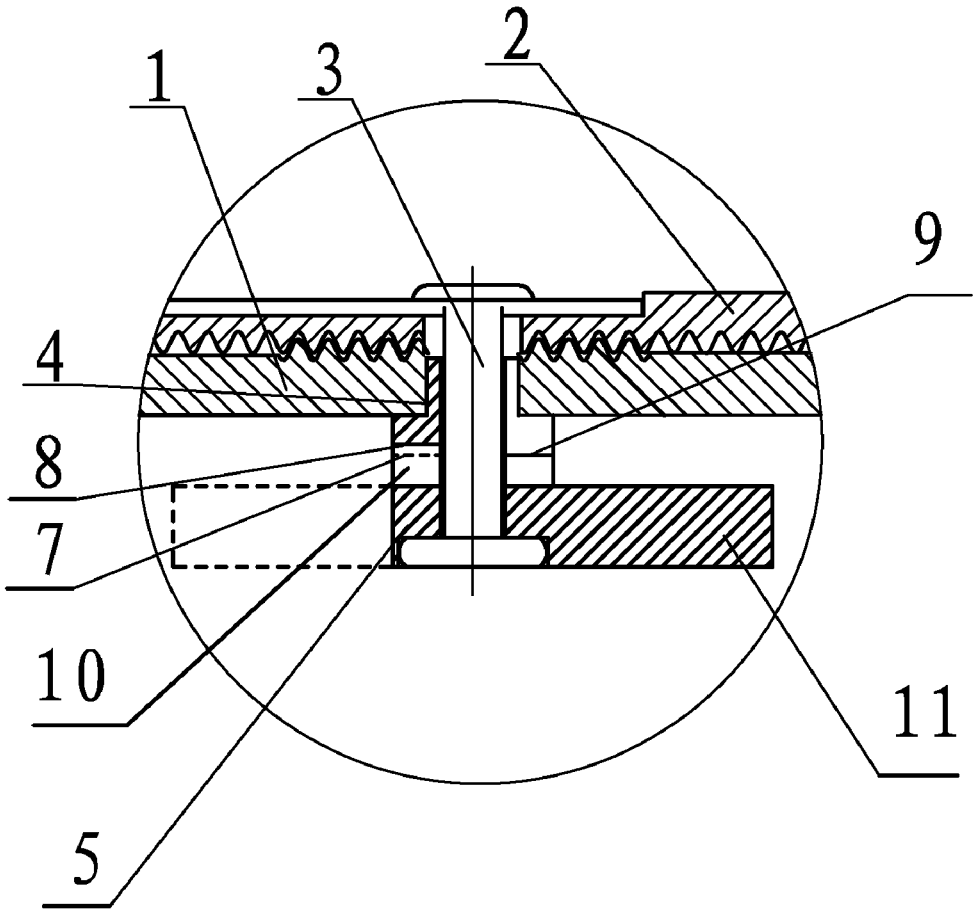
FIG. 3 shows a locked state of the embodiment.

FIG. 3 shows a locking process according to the embodiment. The handle 11 (see FIG. 2) is pushed to rotate, so that the convex block 10 (see FIG. 2) of the movable fastening block 5 is inserted into the locking groove 7 of the fixed fastening block 4, that a fastening bolt 3 (or rivet) correspondingly abuts against the toecap 2, and that the shoe body 1 comes into buckling engagement with the size-adjusting and positioning mechanism of the toecap 2, thereby making it possible for the shoe body 1 and the toecap 2 to slightly and elastically deform. The movable fastening block 5 constantly keeps a predetermined pre-tensioning force due to the elastic deformation to retain the locked state.

Figure 4:
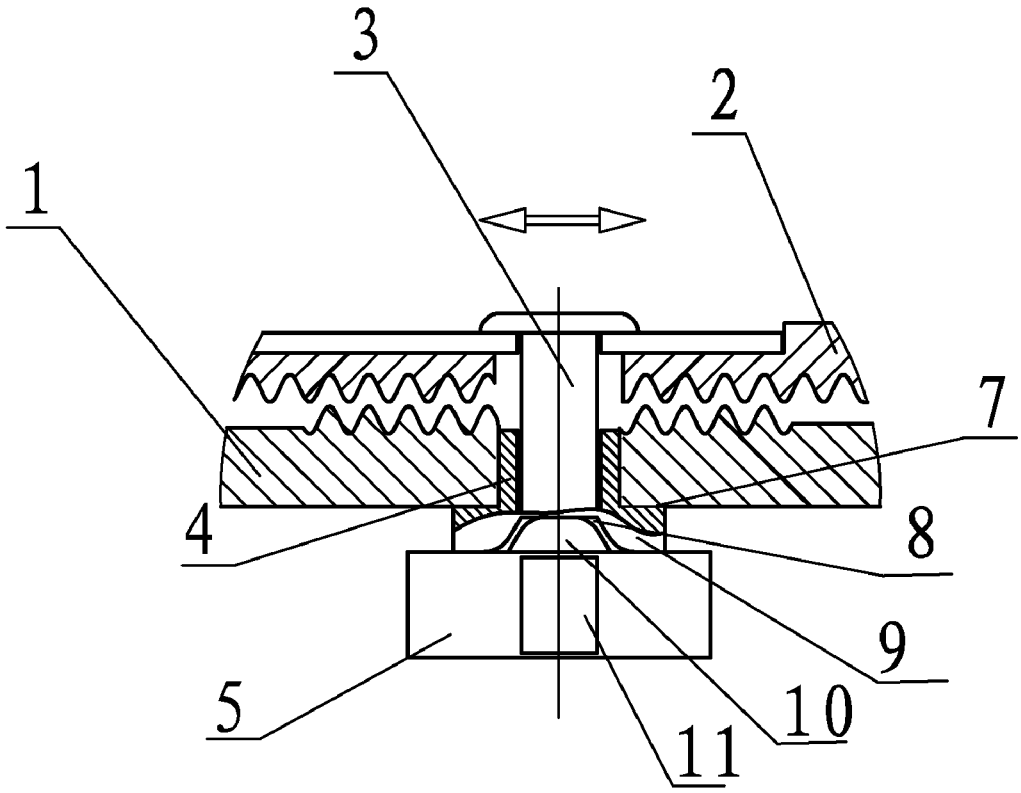
FIG. 4 shows an unlocked state of the embodiment.

FIG. 4 shows an unlocking process according to the embodiment. When it comes to unlocking, the handle 11 (see FIG. 2) of the movable fastening block 5 is pulled, so that its convex block 10 (see FIG. 2) slides away from the locking groove 7 (see FIG. 1). Because the bottom surface of the locking groove 7 is lower than the bottom surface of the unlocking groove 8, and also because their difference in height is greater than a summation of tooth heights of positioning buckle teeth of the shoe body 1 and the toecap 2, when the convex block 10 rotates to a position above the unlocking groove 8 (see FIG. 1) to be inserted into the groove, the buckle teeth of the shoe body 1 and the toecap 2 disengage from one another, and a predetermined space remains after the disengagement, so that the toecap 2 relatively moves in convenience, thereby carrying out the size adjustment.

Upon completion of the size adjustment, the handle 11 is pushed to rotate, so that the convex block 10 is inserted again into the locking groove 7 to thereby finish the aforementioned locking process and lock in position the adjusted size.

Figure 5:
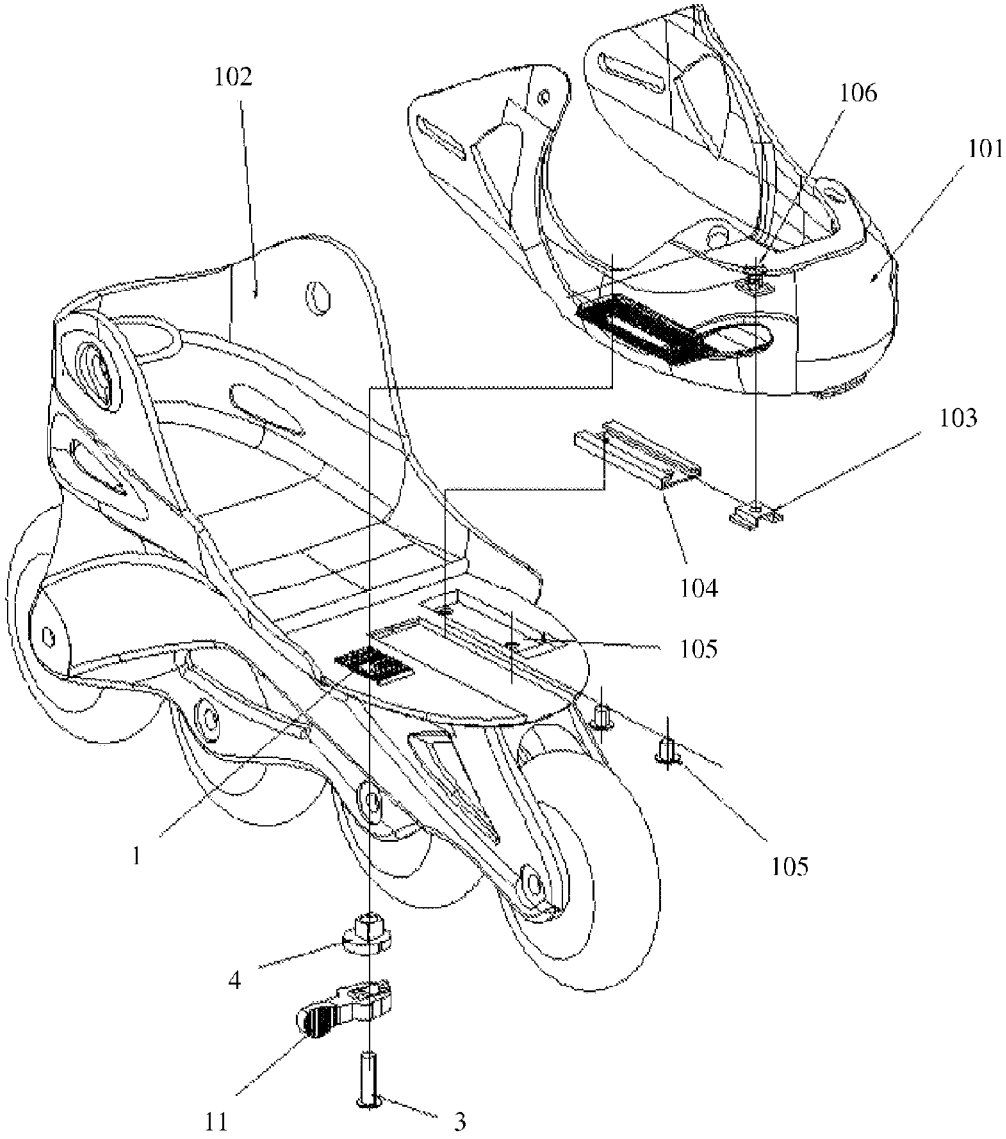
FIG. 5 is a view showing the overall structure of the present invention.
Figure 6:
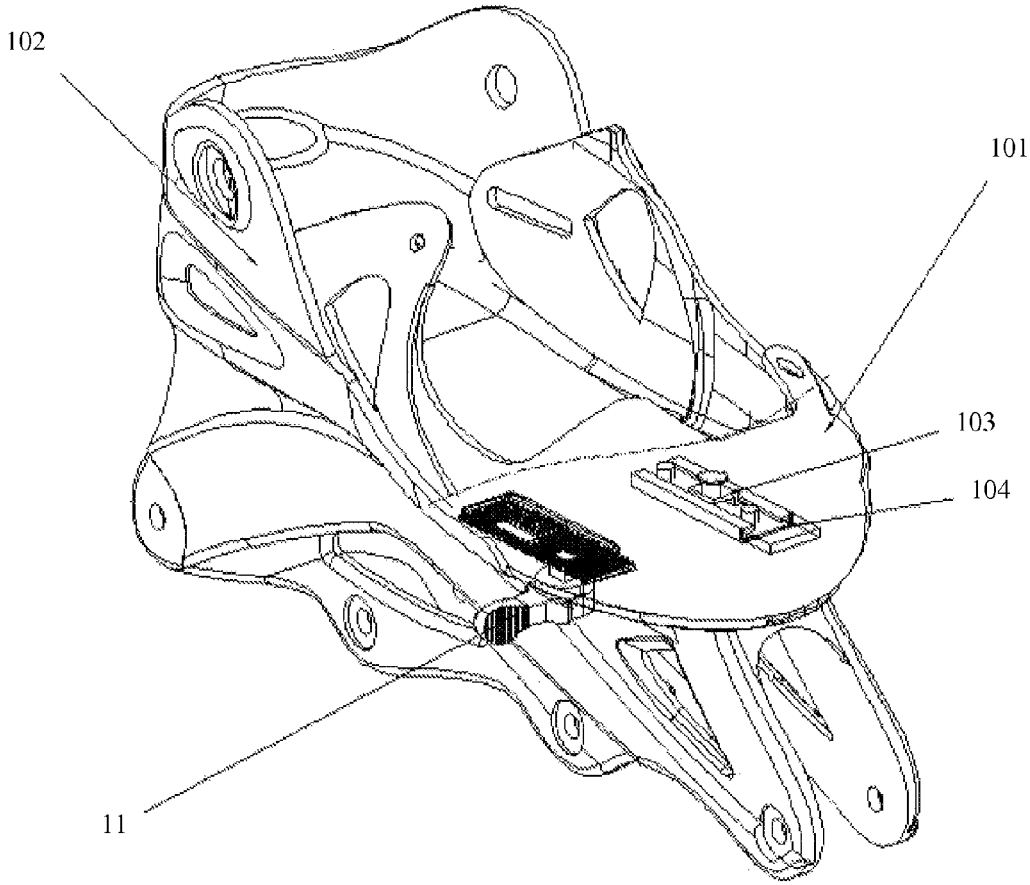
FIG. 6 is a perspective view showing the structure of assembly.
Figure 7:
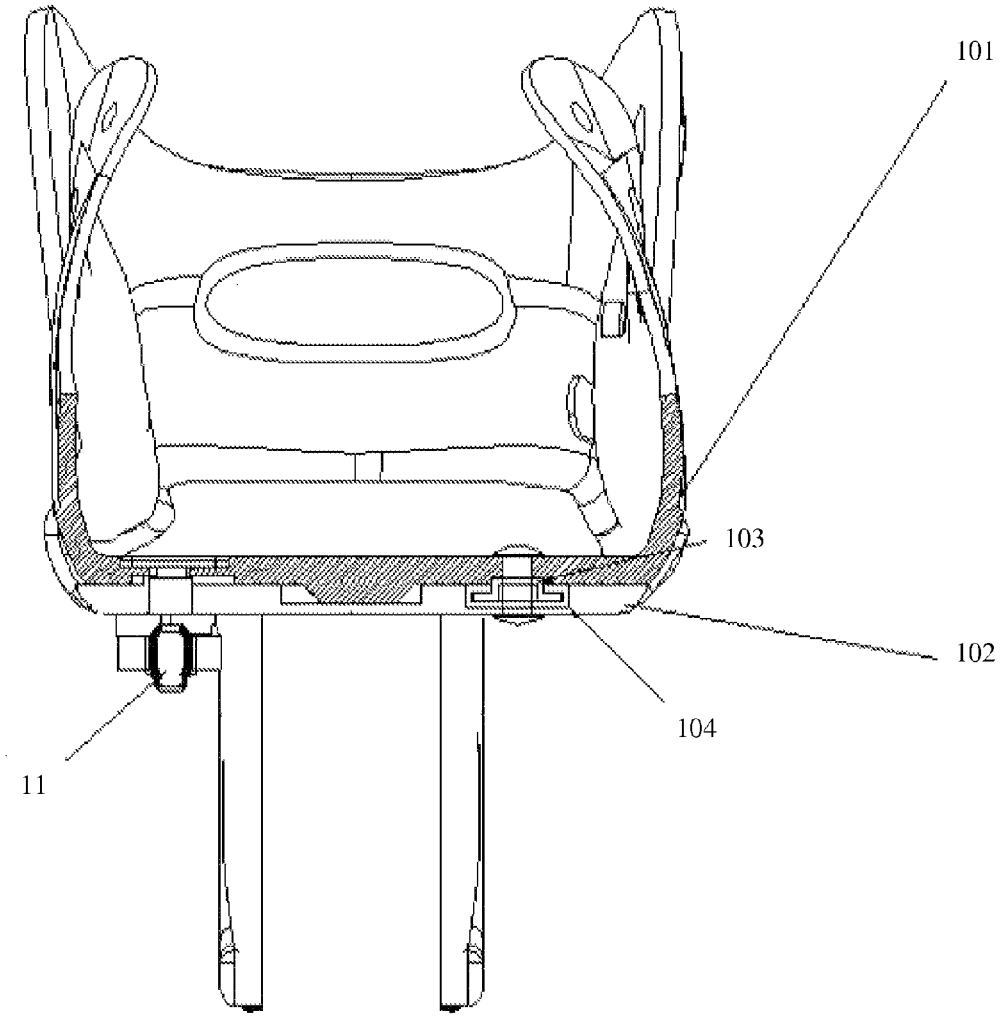
FIG. 7 is a cross-sectional view of assembly.

Referring to FIGS. 5-7, there is shown a skate shoe with size-adjusting fastening mechanism. The skate shoe has a toecap section 101 and a shoe body section 102. Attached to the bottom of the toecap section 101 by a screw or rivet 106 there is an anchor member 103 made of sheet iron with outwardly protruding side-flanges. Seated in an indent 105 of the shoe body section 102 and secured by screws or rivets 105 there is an elongated channel member 104 also made of sheet iron but with inwardly extending side lips. Anchor member 103 can slidably engage with the channel member 104 to quickly position and connect the toecap section 101 and the shoe body section 102. When engaged, the outward flanges of anchor member 103 are sliding and positioned underneath the inward lips of the channel member 104, such that the flanges of the anchor member 103 can slide within a channel space formed by its inward lips of the channel member 104, which allows the adjustment of the size of the skate. Both the anchor member 103 and channel member 104 may be made of sheet iron material.

The aforementioned specific embodiments are merely preferred ones for carrying out the present invention, and any equivalent designs falling within the scope of this patent application for invention should be covered by the technology of the present invention.

What is claimed is:

1. A size-adjusting fastening mechanism applicable for a single-roller or double-roller or ice skate, the skate comprising a shoe body and toecap, the size-adjusting mechanism comprising:

a channel member and an anchor member for connecting the shoe body and toecap, the anchor member slidably engaging the channel member for adjusting a size of the skate;

a moveable fastening block including a ratatable handle disposed on the shoe body, wherein when the handle is in a first position, the moveable fastening block prevents size adjustment of the skate, and when the handle is in a second position perpendicular to the first position, the moveable fastening block permits size adjustment of the skate; and a fixed fastening block disposed above the moveable fastening block, the fixed fastening block including a locking groove and an unlocking groove perpendicularly arranged with respect to each other, wherein a bottom surface of the locking groove has a different height than a bottom surface of the unlocking groove, and wherein moveable fastening block includes a concave portion that is disposed in the locking groove when the handle is in the first position and disposed in the unlocking groove when the handle is in the second position.

2. The size-adjusting fastening mechanism according to claim 1, wherein the anchor member is fixed at the bottom of the toecap.

3. The size-adjusting fastening mechanism according to claim 1, wherein the channel member is fixed in the shoe body.

4. The size-adjusting fastening mechanism according to claim 1, wherein the anchor member is made of sheet iron.

5. The size-adjusting fastening mechanism according to claim 1, wherein the channel member is made of sheet iron.

* * * * *